US007275489B1

(12) United States Patent
Shuert

(10) Patent No.: US 7,275,489 B1
(45) Date of Patent: Oct. 2, 2007

(54) ONE-WAY PLASTIC PALLET

(75) Inventor: Lyle H. Shuert, Bloomfield Hills, MI (US)

(73) Assignee: Schuert Industries, LLC, Sterling Heights, MI (US)

( * ) Notice: Subject to any disclaimer, the term of this patent is extended or adjusted under 35 U.S.C. 154(b) by 0 days.

(21) Appl. No.: 11/248,092

(22) Filed: Oct. 12, 2005

(51) Int. Cl.
*B65D 19/38* (2006.01)

(52) U.S. Cl. ..... 108/57.25

(58) Field of Classification Search ..... 108/57.25, 108/901, 902, 51.11, 57.27, 57.28, 57.26
See application file for complete search history.

(56) References Cited

U.S. PATENT DOCUMENTS

| | | | | | |
|---|---|---|---|---|---|
| 3,467,032 | A * | 9/1969 | Roy et al. | ..... | 108/57.26 |
| 3,667,403 | A * | 6/1972 | Angelbeck, Jr. | ..... | 108/57.26 |
| 3,680,496 | A * | 8/1972 | Westlake, Jr. | ..... | 108/57.26 |
| 4,606,278 | A | 8/1986 | Shuert | ..... | 108/51.1 |
| 4,742,781 | A | 5/1988 | Shuert | ..... | 108/53.3 |
| 5,042,396 | A | 8/1991 | Shuert | ..... | 108/51.1 |
| 5,090,336 | A * | 2/1992 | Longaker et al. | ..... | 108/57.26 |
| 5,117,762 | A | 6/1992 | Shuert | ..... | 108/51.1 |
| 5,391,251 | A * | 2/1995 | Shuert | ..... | 108/57.27 |
| 5,401,347 | A * | 3/1995 | Shuert | ..... | 108/57.27 |
| 5,404,829 | A * | 4/1995 | Shuert | ..... | 108/57.26 |
| 5,470,641 | A * | 11/1995 | Shuert | ..... | 108/57.27 |
| 5,555,820 | A * | 9/1996 | Shuert | ..... | 108/57.25 |
| 5,566,624 | A * | 10/1996 | Brown et al. | ..... | 108/57.28 |
| 5,676,064 | A * | 10/1997 | Shuert | ..... | 108/57.25 |
| 5,791,262 | A * | 8/1998 | Knight et al. | ..... | 108/57.25 |
| 5,996,508 | A * | 12/1999 | Constantino et al. | .... | 108/57.25 |
| 6,018,927 | A * | 2/2000 | Major | ..... | 108/57.25 |
| 6,718,888 | B2 * | 4/2004 | Muirhead | ..... | 108/57.25 |
| 6,955,129 | B2 * | 10/2005 | Moore et al. | ..... | 108/57.25 |

OTHER PUBLICATIONS

Three (3) sheets of material taken from the Internet regarding pallet ("Acra Everest") manufactured by ArcaSystems.

* cited by examiner

*Primary Examiner*—José V. Chen
(74) *Attorney, Agent, or Firm*—Young Basile

(57) ABSTRACT

A thermoformed twin sheet pallet comprising an upper plastic sheet and a lower plastic sheet, the sheets being fused together to form a platform structure and a plurality of leg structures downstanding from the platform structure in spaced relation and defining a plurality of forklift passages therebetween. The leg structures are formed of spaced downstanding leg portions of the upper sheet fused in vertically overlapping relation to spaced upstanding leg portions of the lower sheet, and main body planar portions of the upper sheet between the spaced downstanding leg portions coact with main body planar portions of the lower sheet between the spaced upstanding leg portions to define the forklift passages. The lower sheet further includes an upstanding flange portion extending around the perimeter of the lower sheet and fused to the perimeter of the upper sheet and openings are provided in the flange portion, in alignment with the forklift passages, to provide forklift access to the forklift passages. A flap is provided in each opening which is yieldable to allow entry of a forklift into the opening for access to the respective forklift passage. The downstanding leg portions of the upper sheet comprise clusters of hollow protrusions opening in the upper face of the upper sheet and the upstanding leg portions of the lower sheet comprise clusters of hollow protrusions opening in the lower face of the lower sheet and including sidewalls fused to sidewalls of the downstanding protrusions of the upper sheet.

20 Claims, 6 Drawing Sheets

ONE-WAY PLASTIC PALLET

FIELD OF THE INVENTION

This invention relates to shipping and storage pallets and more particularly to pallets having a plastic construction.

BACKGROUND OF THE INVENTION

Pallets have traditionally been formed of wood. Wood pallets however have many disadvantages. For example, they are subject to breakage and they take up a considerable amount of valuable floor space in the warehouse when they are not in use. They are also difficult to maintain in a sanitary condition, thus limiting their usability in applications where sanitation is important, for example, in food handling application.

In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectively fused or knitted together in a suitable press to form a reinforced double wall structure. Whereas these twin sheet plastic pallets are generally satisfactory, they tend to be more expensive than comparable wood pallets and, in particular, their relatively higher cost has precluded their use in one-way applications where the pallet, after fulfilling an initial shipping or material handling assignment, is not reused but rather is destroyed or recycled after the single use.

SUMMARY OF THE INVENTION

This invention is directed to the provision of a plastic pallet which is relatively inexpensive.

More specifically, this invention is directed to the provision of a plastic pallet that is producible at a price that makes the pallet feasible for one-way usage.

This invention relates to a thermoformed twin sheet pallet comprising an upper plastic sheet and a lower plastic sheet, the sheets being fused together to form a platform structure and a plurality of leg structures downstanding from the platform structure in spaced relation and defining a plurality of forklift passages therebetween.

According to the invention, the leg structures are formed of spaced downstanding leg portions of the upper sheet fused in vertically overlapping relation to spaced upstanding leg portions of the lower sheet and main body planar portions of the upper sheet between the spaced downstanding leg portions coact with main body planar portions of the lower sheet between the spaced upstanding leg portions to define the forklift passages. This arrangement allows the provision of an inexpensive pallet with adequate leg structures and well defined forklift passages.

According to a further feature of the invention, the lower sheet further includes an upstanding flange portion extending around the perimeter of the lower sheet and fused to the perimeter of the upper sheet, and openings are provided in the flange portion, in alignment with the forklift passages, to provide forklift access to the forklift passages. This arrangement further strengthens the pallet while not inhibiting access to the forklift passages.

According to a further feature of the invention, a flap is provided in each opening which is yieldable to allow entry of a forklift into the opening for access to the respective forklift passage. This arrangement protects the forklift passages from debris, is providable at no additional cost, and does not inhibit access to the forklift passages.

According to a further feature of the invention, the downstanding leg portions of the upper sheet comprise upper hollow protrusions opening in the upper face of the upper sheet and the upstanding leg portions of the lower sheet comprise lower hollow protrusions opening in the lower face of the lower sheet and including sidewalls fused to sidewalls of the upper protrusions. This arrangement provides an extremely thin pallet with adequate leg strength and with well defined forklift passages.

In the disclosed embodiment of the invention the plurality of upstanding protrusions are fused to certain of the downstanding protrusions and, specifically, at least three upstanding protrusions are fused to at least some of the downstanding protrusions and conversely, at least three downstanding protrusions are fused to at least some of the upstanding protrusions.

According to a further feature of the invention, main body planar portions of the upper sheet between the leg structures coact with main body planar portions of the lower sheet between the leg structures to define upper and lower boundaries of the forklift passages and the vertical boundaries of the forklift passages are defined by the leg structures. This arrangement provides totally defined forklift passages in an inexpensive manner.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
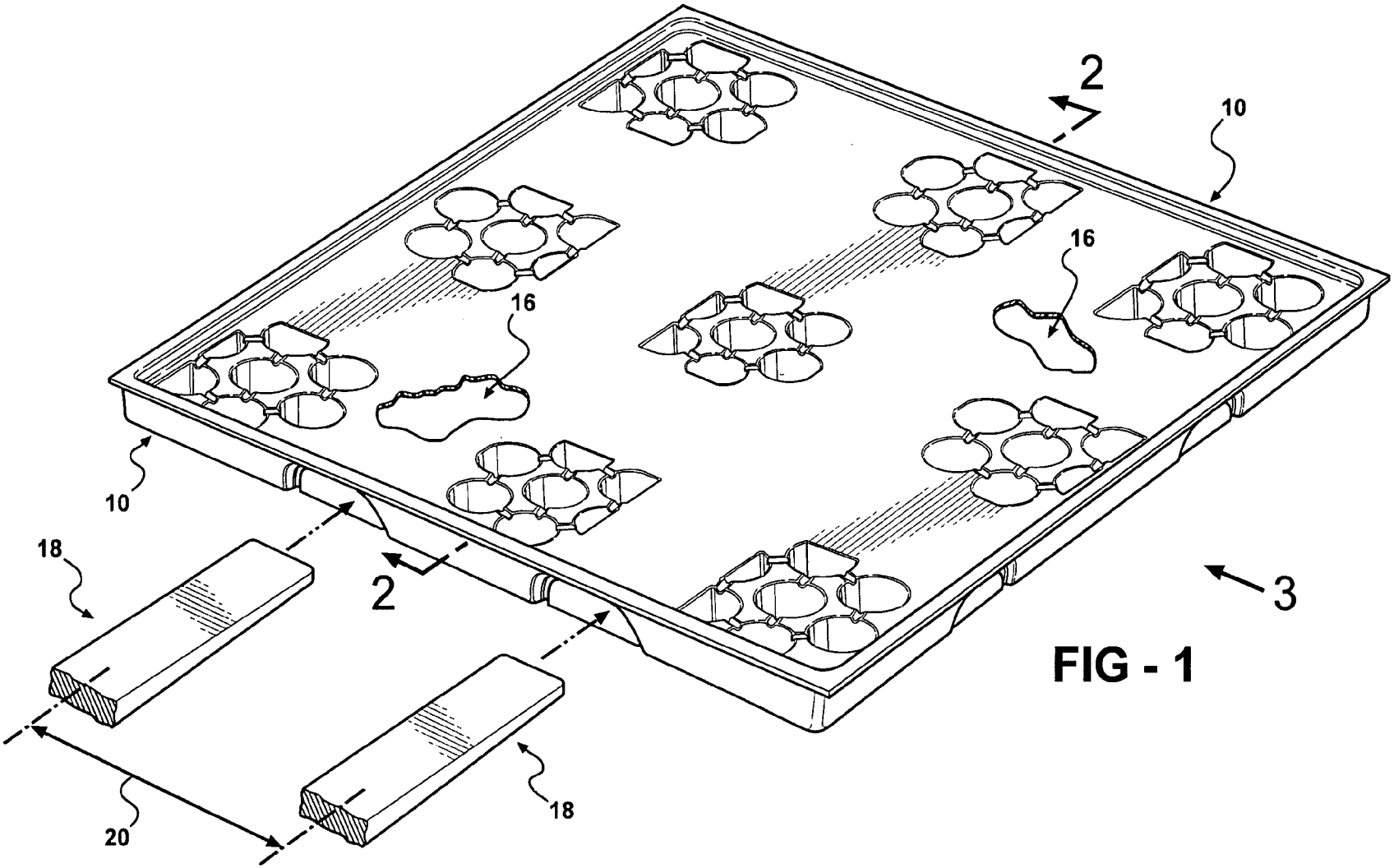
FIG. 1 is a perspective view of a pallet according to the invention.
Figure 2:
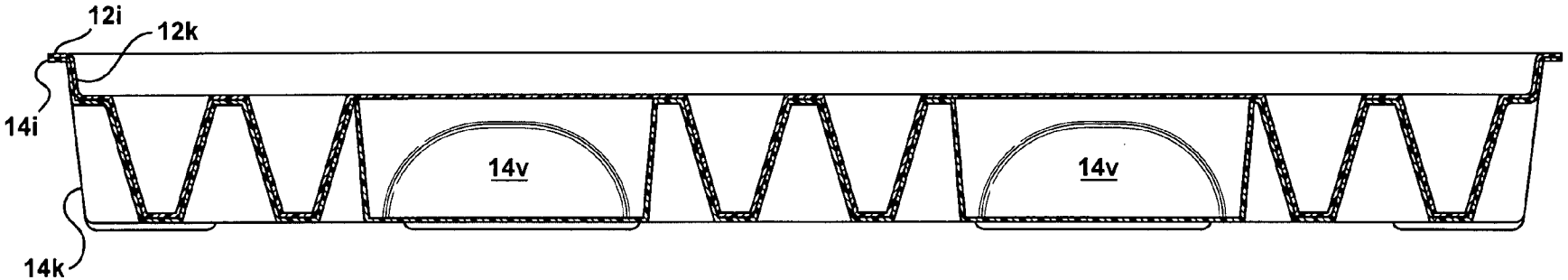
FIG. 2 is a cross-sectional view taken on line 2-2 of FIG. 1.
Figure 3:
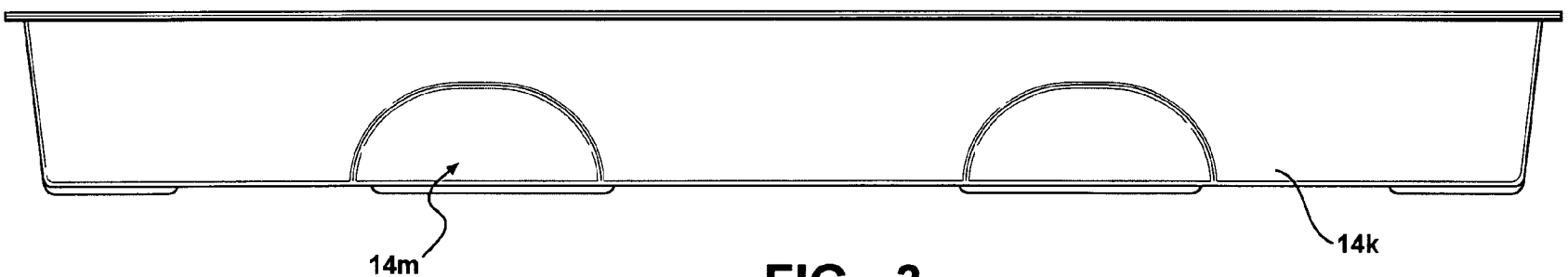
FIG. 3 is an end view of the pallet looking in the direction of the arrow 3 in FIG. 1.
Figure 4:
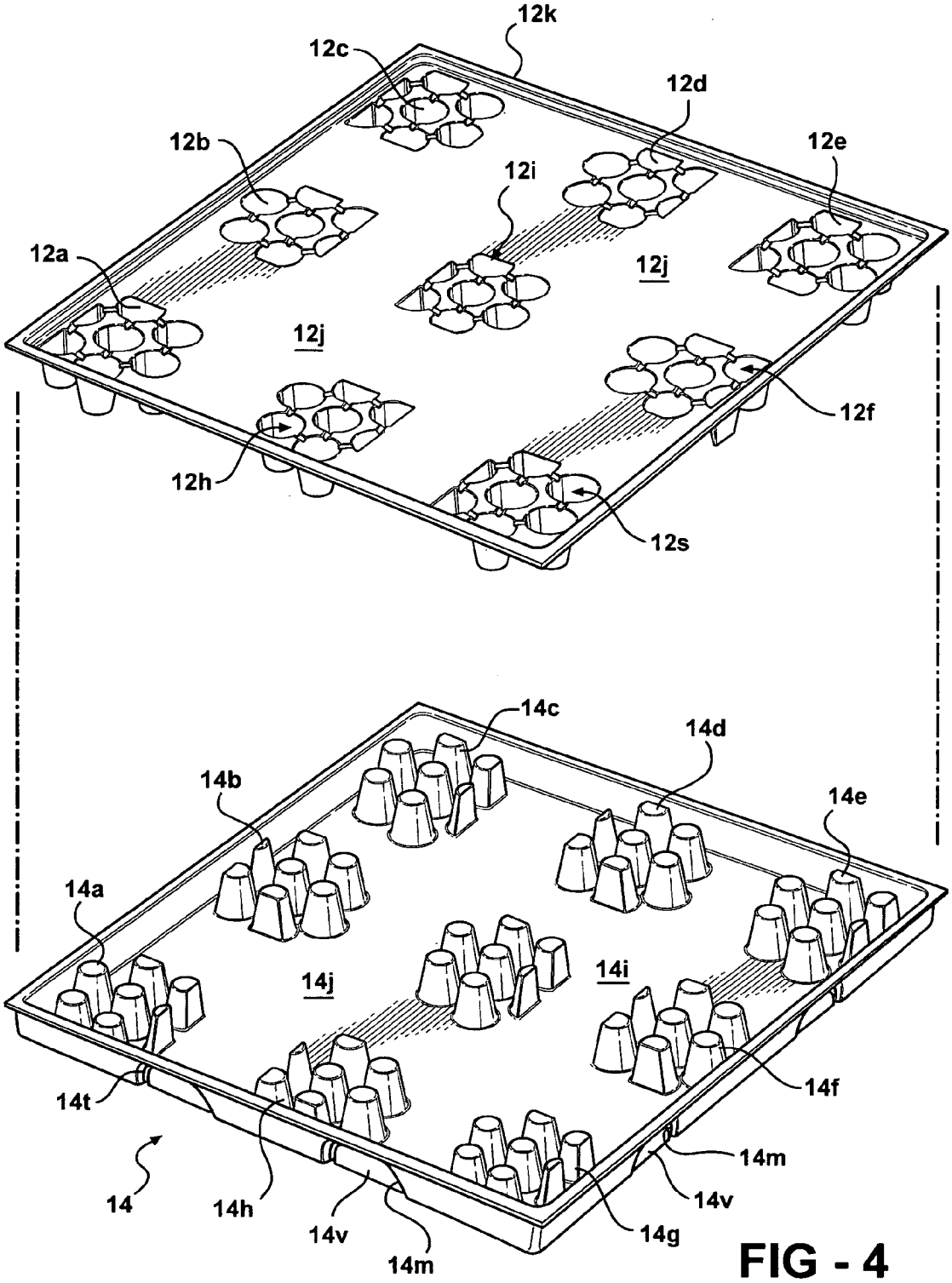
FIG. 4 is an exploded perspective view of the pallet.

The pallet 10 of the invention, broadly considered, comprises an upper plastic sheet 12 and a lower plastic sheet 14. Sheets 12 and 14 are preferably formed of a polyethylene material and may have a thickness of approximately 0.070 inches. In overview, each sheet is formed in a vacuum thermoforming operation and the upper and lower sheets, while still in a heated fuseable condition, are brought together to selectively fuse portions of the upper sheet to portions of the lower sheet to form the pallet.

Upper sheet 12 has a generally rectangular configuration and includes leg portions 12*a*-12*i* and planar main body portions 12*j* between the leg portions. Sheet 12 also includes an upstanding flange 12*k* extending around the periphery of the sheet and terminating in an outwardly extending lip 12*i*.

Each leg portion 12*a*-12*i* is constituted by a cluster of downwardly extending hollow protrusions 12*m*. Each protrusion has a circular transverse cross-section and a frusto conical vertical cross-section. Specifically, each protrusion 12*m* includes an annular, conical sidewall 12*n* and a bottom wall 12*p* and opens in the upper face of sheet 12 at 12*q*. Each upper sheet protrusion cluster has a rectangular overall configuration and includes parallel, offset rows of protrusions with the circular configuration of peripheral protrusions in the cluster sacrificed or flatted as necessary, and as seen at 12*r*, to maintain the overall rectangular configuration of the cluster. The protrusion rows of the corner leg portion clusters 12*a*, 12*c*, 12*e* and 12*g* may extend on a bias or diagonal with respect to the side edges of the sheet and the protrusion rows of the remaining leg portion clusters may extend parallel to the side edges of the sheet.

Lower sheet 14 has a rectangular configuration conforming generally to the rectangular configuration of upper sheet 12 and includes leg portions 14*a*-14*i*, correspondingly respectively to upper sheet leg portions 12*a*-12*i*, and planar main body portions 14*j* between the leg portions, corresponding to upper sheet planar main body portions 12*j*. Sheet 14 also includes an upstanding flange portion 14*k* extending around the perimeter of the sheet outside of the leg portions 14*a*-14*i* and terminating in an outwardly extending lip 14*l*. Flange 14*k* is formed with a pair of spaced recessed or depressed regions 14*m* along each side of the flange with the depressed regions aligned generally with planar main body portions 14*j*.

Each leg portion 14*a*-14*i* is constituted by a cluster of upwardly extending hollow protrusions 14*n*. Each protrusion has a circular transverse cross-section and a frusto conical vertical cross-section. Specifically, each protrusion 14*n* includes an annular conical side wall 14*p* and a top wall 14*q* and opens in the lower face of sheet 14 at 14*r*. Each lower sheet protrusion cluster has a rectangular overall configuration, conforming to the rectangular configuration of the respective corresponding upper sheet cluster, and includes parallel offset rows of protrusions with the circular configuration of peripheral protrusions in the cluster sacrificed or flatted as necessary, and as seen at 14*s*, to maintain the overall rectangular configuration of the cluster. The protrusion rows of the corner leg portion clusters 14*a*, 14*c*, 14*e* and 14*g* may extend on a bias or diagonal with respect to the side edges of the sheet and the protrusion rows of the remaining leg portion clusters may extend parallel to the side edge of the sheet.

As previously indicated, after the individual upper and lower sheets are thermoformed in a vacuum molding procedure, the sheets, while still in a heated state, are brought together to form the pallet. Specifically, flange 12*k* fuses to flange 14*k*, lip 12*l* fuses to lip 14*l*, and the upper sheet protrusion clusters mesh with and fuse to the lower sheet protrusion clusters to form a pallet in which the upper face of the upper sheet defines a platform structure for the pallet and the protrusion clusters of the upper and lower sheets are fused together to form leg structures extending downwardly from the platform structure.

Figure 5:
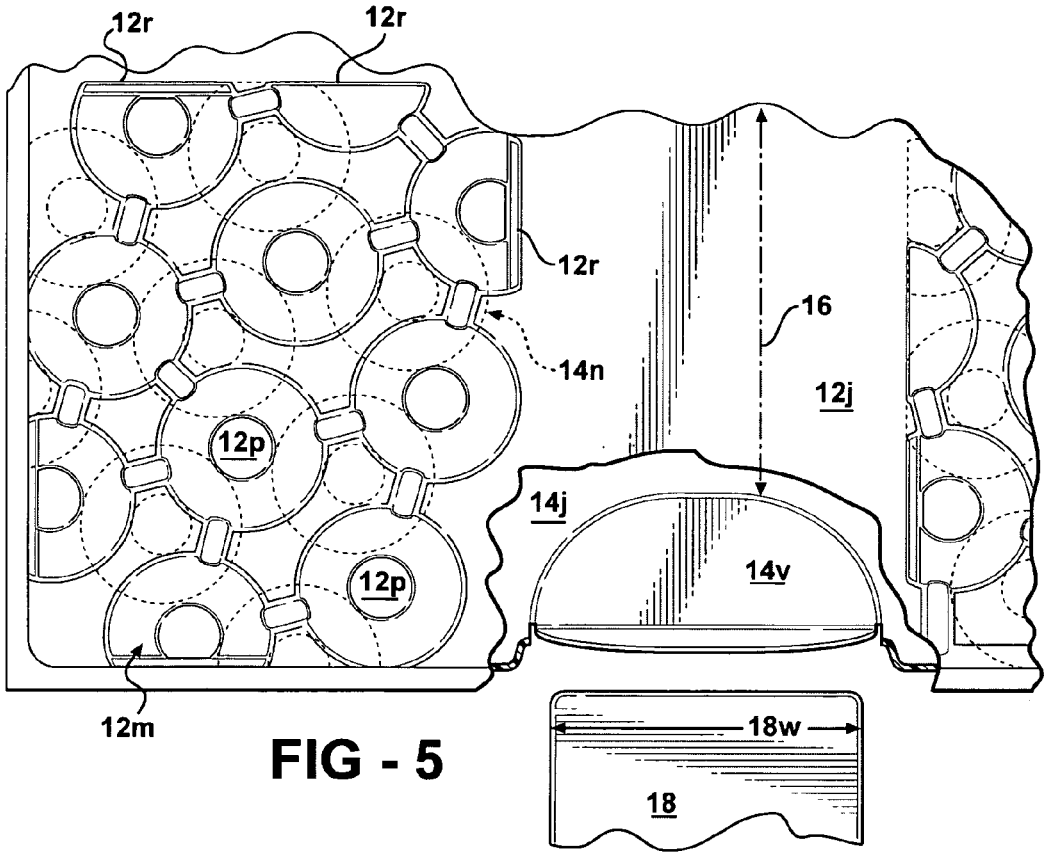
FIG. 5 is a fragmentary top view of the pallet.
Figure 6:
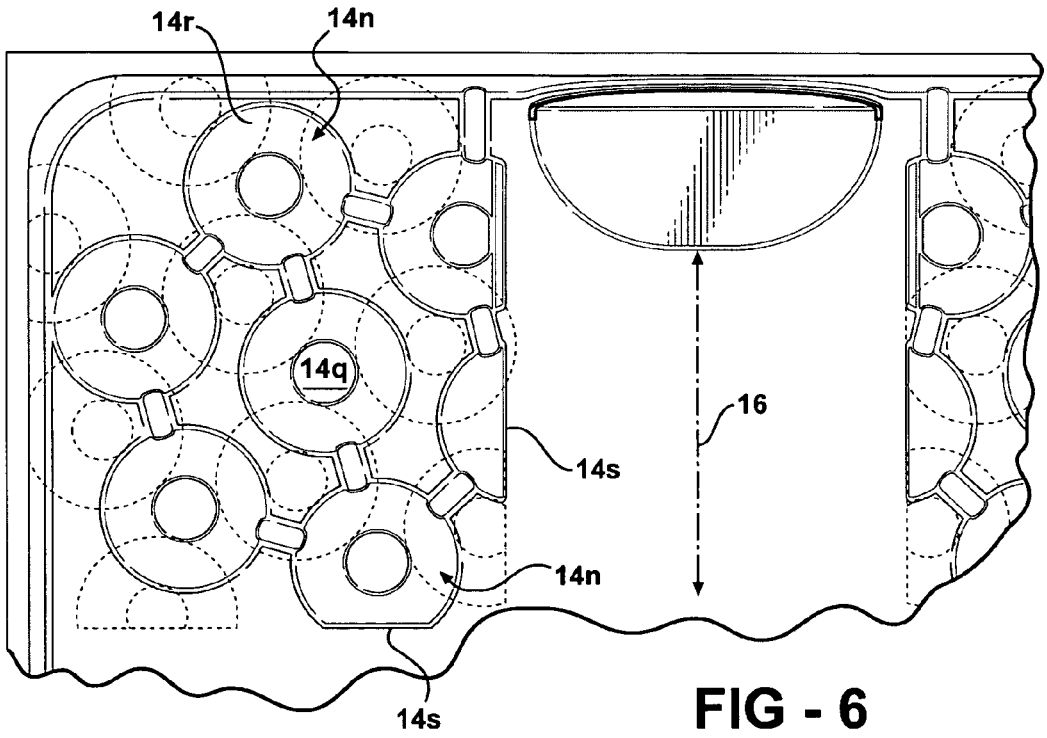
FIG. 6 is a fragmentary bottom view of the pallet.
Figure 7:
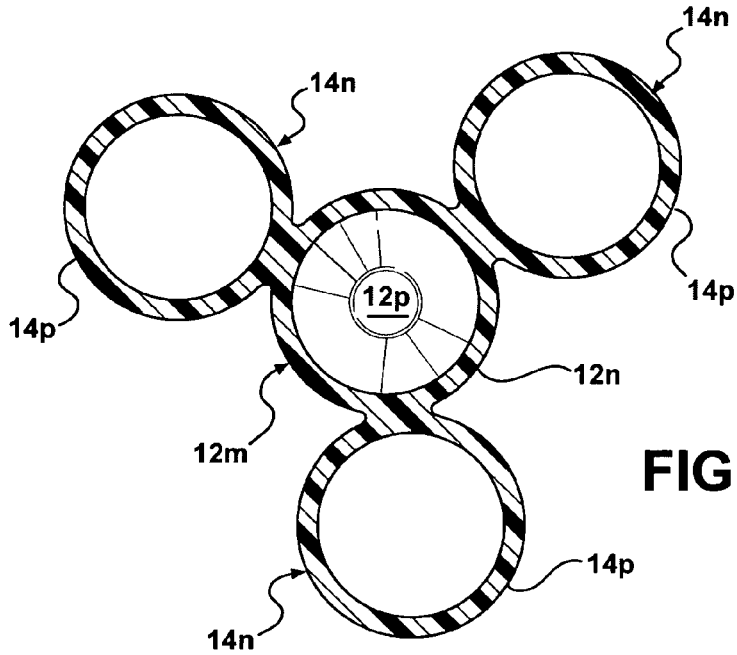
FIG. 7 is a fragmentary cross sectional view of a pallet leg structure.
Figure 8:
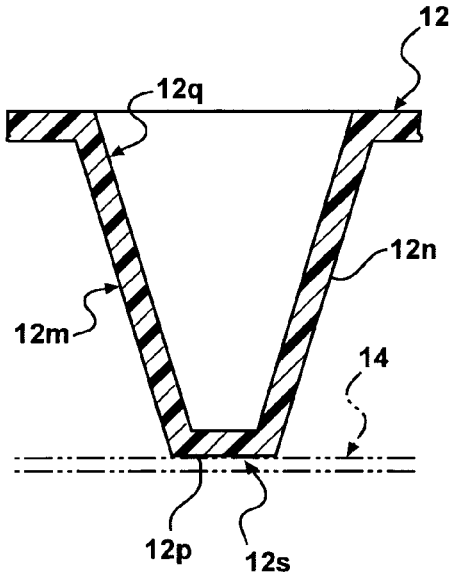
FIGS. 8 and 9 are detail views showing protrusions utilized in the leg structures.
Figure 9:
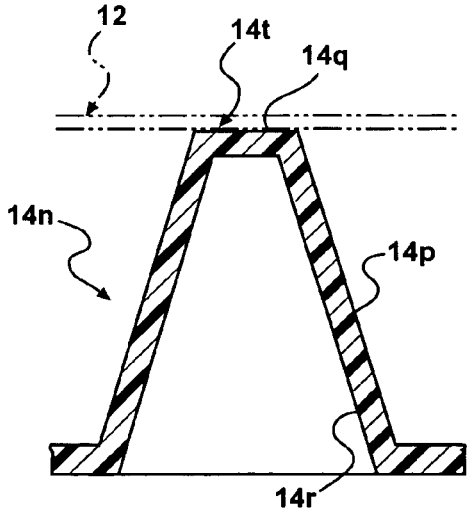
Figure 10:
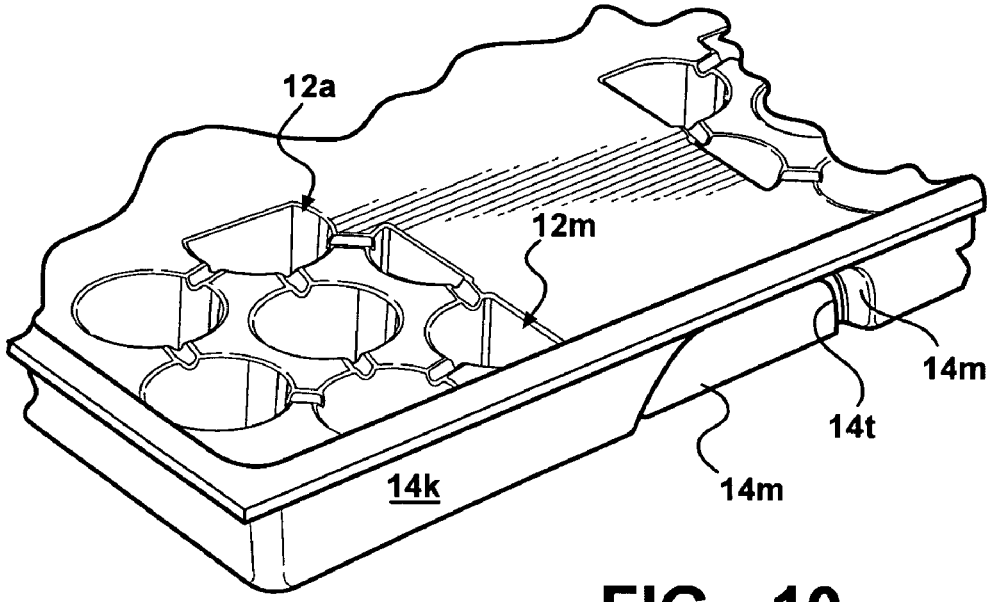
FIG. 10 is a fragmentary perspective view looking in the direction of the arrow 10 in FIG. 1.
Figure 11:
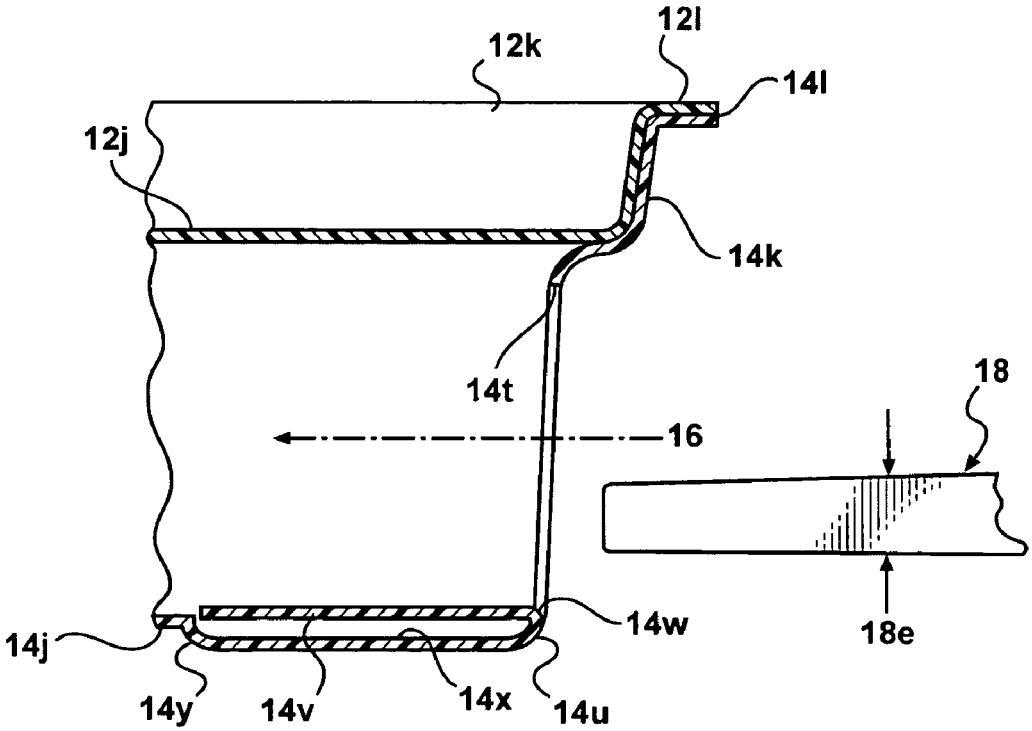
FIG. 11 is a fragmentary cross-sectional view of the pallet.

The protrusion rows of the lower sheet clusters are offset with respect to the protrusion rows of the upper sheet clusters such that, as the vacuum formed and still heated sheets are brought together to form the pallet, the upstanding protrusions of the lower sheet clusters intermesh with the downstanding protrusions of the upper sheet clusters. Specifically, as best seen in FIGS. 5, 6 and 7, in each cluster the annular side walls of the downstanding protrusions that are central to the cluster intermesh and form a fusion line with the annular side walls of three of the upstanding protrusions and, similarly, the annular sidewalls of the upstanding protrusions that are central to the cluster intermesh with and form a fusion line with the annular sidewalls of three downstanding protrusions. The spacing of the parallel protrusion rows and the staggering of the rows are chosen such that the three fusion lines formed on the sidewalls of a central downstanding protrusion are equispaced about the circumference of that protrusion as are the three fusion lines formed on the sidewall of a central upstanding protrusion. It will be understood that protrusions that are peripheral to a cluster will, by pure geometric considerations, have fewer than three fusion lines. The protrusions are further sized to insure that, with the upstanding and downstanding protrusions intermeshed and fused together, the top walls 14*q* of each upstanding protrusion abut against and fuse to the underface of the upper sheet as seen at 14*t* in FIG. 9, and the bottom wall 12*p* of each downstanding protrusion abuts against and fuses to the upper face of the lower sheet, as seen at 12*s*. With the upper and lower sheets fused together to form the pallet, it will be seen that the leg structures of the pallet are formed of spaced downstanding leg portions of the upper sheet fused in vertically overlapping relation to spaced upstanding leg portions of the lower sheet and the main body planar portions 12*j* of the upper sheet coact with the main body planar portion 14*j* of the lower sheet to define a pair of forklift passages 16 extending transversely of the pallet and a further pair of forklift passages 16 extending lengthwise of the pallet. Specifically, the clusters are spaced apart sufficiently to insure that each passage 16 has a width sufficient to accommodate the width 18*w* of a forklift 18; the protuberances have a vertical dimension such that the space between the sheets, and thereby the height of each passage 16, is sufficient to accommodate the thickness 18*t* of a forklift 18; and the spacing between each pair of parallel forklift passages corresponds to the spacing 20 between the spaced parallel forks 18 of a forklift truck.

Following the formation of the pallet, the flange 14*k* of the lower sheet is selectively cut or scored within the depression 14*m* along score lines 14*t* to form an opening 14*u* in each depression which is closed by a flap 14*v* having a fold line or fulcrum 14*w*. Each opening 14*u* will be seen to be aligned with a respective forklift passage 16 and each forklift passage may be readily accessed by the forklift 18 of a forklift truck by pressing the forklift against the flap 14*v* to pivot the flap about its fulcrum 14*m* and move the flap into a recess 14*x* defined by a bulge 14*y* formed in the lower face of the lower sheet proximate each depression 14*m*.

In the competed pallet it will be seen that the main body portions 12*j* of the upper sheet define an upper boundary of the forklift passages 16, the main body portions 14*j* of the lower sheet define the lower boundaries of the forklift passages, and the leg structures as defined by the intermeshed protrusion clusters define the vertical boundaries of the forklift passages. Note in this regard, and as best seen in FIGS. 5 and 6, that the flatted sides 12*r* and 14*s* of the peripheral protuberances in each cluster serve to define a generally rectangular shape for each cluster and further serve to define generally smooth vertical boundaries for the forklift passages.

It has been found that the pallet of the invention, by virtue of its simple construction and its use of thin plastic sheeting, can be produced at a cost that renders the pallet feasible for use in one way applications where the pallet, after fulfilling an initial shipping or material handling assignment, is not reused but rather is destroyed or recycled after the single use.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A thermoformed twin sheet plastic pallet consisting of an upper plastic sheet and a lower plastic sheet, the upper and lower sheets being fused together to form a platform structure and a plurality of leg structures downstanding from the platform structure in spaced relation and defining a plurality of forklift passages therebetween, characterized in that:

the leg structures comprise spaced clusters of downstanding protrusions in the upper sheet fused in vertically overlapping relation to spaced clusters of upstanding protrusions in the lower sheet;

the downstanding protrusions in each cluster of downstanding protrusions are intermeshed with and fused to the upstanding protrusions in a cluster of upstanding protrusions; and main body flat planar portions of the upper sheet, located between the spaced clusters of downstanding protrusions and devoid of protrusions, coact with main body flat planar portions of the lower sheet, located between the spaced clusters of upstanding protrusions and devoid of protrusions, to define upper and lower boundaries of the forklift passages with the vertical boundaries of the forklift passages defined by the leg structures.

2. A pallet according to claim 1 wherein:

the clusters of downstanding protrusions in the upper sheet comprise upper, hollow protrusions opening in the upper face of the upper sheet; and the clusters of upstanding protrusions in the lower sheet comprise lower, hollow protrusions opening in the lower face of the lower sheet and including side walls fused to side walls of the upper protrusions.

3. A pallet according to claim 2, wherein a plurality of upstanding protrusions are fused to a least certain of the downstanding protrusions.

4. A pallet according to claim 3, wherein at least three upstanding protrusions are fused to at least one of the downstanding protrusions.

5. A pallet according to claim 2, wherein each protrusion has a frusto conical vertical cross-section.

6. A pallet according to claim 1, wherein:

the upper and lower sheets have a generally rectangular configuration; and leg structures are defined at the corners of the pallet and at intermediate locations along each side of the pallet, whereby to define a pair of forklift passages extending lengthwise of the pallet and a pair of forklift passages extending crosswise of the pallet.

7. A thermoformed twin sheet plastic pallet consisting of an upper plastic sheet and a lower plastic sheet, the upper and lower sheets being fused together to form a platform structure and a plurality of leg structures downstanding from the platform structure and defining a plurality of forklift passages therebetween, characterized in that:

the leg structures comprise spaced clusters of downstanding protrusions in the upper sheet fused in vertically overlapping relation to spaced clusters of downstanding protrusions in the lower sheet;

the downstanding protrusions in each cluster of downstanding protrusions are intermeshed with and fused to the upstanding protrusions in a cluster of upstanding protrusions;

main body planar portions of the upper sheet between the leg structures coact with main body planar portions of the lower sheet between the leg structures to define upper and lower boundaries of the forklift passages;

the clusters of upstanding and downstanding protrusions coact to define vertical side boundaries for the forklift passages; and the lower sheet further includes an upstanding flange portion extending around the perimeter of the lower sheet and extending upwardly outside of the leg structures for fusion to the perimeter of the upper sheet.

8. A thermoformed twin sheet plastic pallet comprising an upper plastic sheet and a lower plastic sheet, the sheets being fused together to form a platform structure and a plurality of leg structures downstanding from the platform structure and defining a plurality of forklift passages therebetween, characterized in that:

the upper sheet includes spaced clusters of protrusions extending downwardly from the upper sheet and planar main body portions between the clusters;

the lower sheet includes spaced clusters of hollow protrusions extending upwardly form the lower sheet and planar main body portions between the clusters;

the protrusions in each cluster of upstanding protrusions are intermeshed with and fused to the protrusions in a cluster of downstanding protrusions;

the main body portions of the upper sheet define the upper boundary of the forklift passages;

the main body portions of the lower sheet define the lower boundaries of the forklift passages;

the leg structures define vertical boundaries of the forklift passages;

the lower sheet further includes an upstanding flange portion extending around the perimeter of the lower sheet and extending upwardly outside of the leg structures for fusion to the perimeter of the upper sheet; and the forklift passages include a pair of parallel forklift passages each extending across the pallet from a location proximate a section of the flange portion to a location proximate an opposite section of the flange portion; and openings are provided in the flange portion sections, in alignment with the forklift passages, to provide forklift access to the forklift passages.

9. A pallet according to claim 8, wherein a flap is provided in each opening which is yieldable to allow entry of a forklift into the opening for access to the respective forklift passage.

10. A twin sheet plastic pallet including a plastic upper sheet and a plastic lower sheet selectively fused together to form the pallet, characterized in that:

one of the sheets has a plurality of spaced clusters of protuberances extending outwardly from the general plane of the sheet;

the sheets are fused together with the clusters of protuberances positioned between the sheets to define a space between the sheets and define a plurality of leg structures for the pallet constituted by the clusters of protuberances;

the clusters are spaced apart sufficiently to define parallel passages therebetween each having a width sufficient to accommodate the width of a fork of a forklift truck;

the protuberances have a vertical dimension such that the space between the sheets is sufficient to accommodate the thickness of the fork; and the spacing between and the pattern of the clusters of protuberances is such that the spacing between the parallel passages corresponds to the spacing between the forks of a forklift truck.

11. A twin sheet pallet according to claim 10 wherein:

the other sheet also has a plurality of spaced clusters of protuberances extending outwardly from the general plane of the sheet and corresponding in number and spacing to the clusters of protuberances on the one sheet; and with the sheets fused together the protrusions of the clusters of protrusions of the one sheet intermesh with the protrusions of the clusters of the protrusions of the other sheet.

12. A thermoformed twin sheet plastic pallet comprising an upper plastic sheet and a lower plastic sheet, the sheets being fused together to form a platform structure and a plurality of leg structures downstanding from the platform structure in spaced relation and defining a plurality of forklift passages therebetween, characterized in that:

the leg structures are formed of spaced downstanding leg portions of the upper sheet fused in vertically overlapping relation to spaced upstanding leg portions of the lower sheet; and main body planar portions of the upper sheet between the spaced downstanding leg portions coact with main body planar portions of the lower sheet between the spaced upstanding leg portions to define the forklift passages;

the lower sheet further includes an upstanding flange portion extending around the perimeter of the lower sheet and fused to the perimeter of the upper sheet;

the forklift passages include a pair of parallel forklift passages extending across the pallet from a location proximate a section of the flange portion to a location proximate an opposite section of the flange portion; and openings are provided in the flange portion sections in alignment with the forklift passages to provide forklift access to the forklift passages.

13. A pallet according to claim 12 wherein a flap is provided in each opening which is yieldable to allow entry of a forklift into the opening for access to the respective forklift passage.

14. A thermoformed twin sheet plastic pallet comprising an upper plastic sheet and a lower plastic sheet, the sheets being fused together to form a platform structure and a plurality of leg structures downstanding from the platform structure in spaced relation and defining a plurality of forklift passages therebetween, characterized in that:

the leg structures are formed of spaced downstanding leg portions of the upper sheet fused in vertically overlapping relation to spaced upstanding leg portions of the lower sheet;

main body planar portions of the upper sheet between the spaced downstanding leg portions coact with main body planar portions of the lower sheet between the spaced upstanding leg portions to define the forklift passages;

the downstanding leg portions of the upper sheet comprise upper, hollow protrusions opening in the upper face of the upper sheets;

the upstanding leg portions of the lower sheet comprise lower, hollow protrusions opening in the lower face of the lower sheet and including side walls fused to the side walls of the upper protrusions;

a plurality of upstanding protrusions are fused to at least certain of the downstanding protrusions;

at least three upstanding protrusions are fused to at least one of the downstanding protrusions;

the protrusions have a circular transverse cross-section; and lines of fusion are formed between the three upstanding protrusions and the one downstanding protrusion and the lines of fusion are spaced circumferentially about the one downstanding protrusion.

15. A pallet according to claim 14, wherein the lines of fusion are spaced equally about the circumference of the one downstanding protrusion.

16. A thermoformed twin sheet plastic pallet comprising an upper plastic sheet and a lower plastic sheet, the sheets being fused together to form a platform structure and a plurality of leg structures downstanding from the platform structure and defining a plurality of forklift passages therebetween, characterized in that:

main body planar portions of the upper sheet between the leg structures coact with main body planar portions of the lower sheet between the leg structures to define upper and lower boundaries of the forklift passages;

the leg structures coact to define vertical side boundaries for the forklift passages;

the lower sheet further includes an upstanding flange portion extending around the perimeter of the lower sheet and extending upwardly outside of the leg structures for fusion to the perimeter of the upper sheet;

the forklift passages include a pair of parallel forklift passages extending across the pallet from a location proximate a section of the flange portion to a location proximate an opposite section of the flange portion; and openings are provided in the flange portion sections, in alignment with the forklift passages, to provide forklift access to the forklift passages.

17. A pallet according to claim 16, wherein a flap is provided in each opening which is yieldable to allow entry of a forklift into the opening for access to the respective forklift passage.

18. A pallet according to claim 17, wherein each leg structure is constituted by a plurality of hollow protrusions upstanding from the lower sheet fused to a plurality of hollow protrusions downstanding from the upper sheet.

19. A pallet according to claim 18, wherein:

each protrusion includes a sidewall; and the upstanding and downstanding protrusions are fused together along interfacing sidewalls.

20. A pallet according to claim 19, wherein at least one downstanding protrusion is fused to at least three upstanding protrusions.

* * * * *